US006637921B2

(12) United States Patent
Coushaine

(10) Patent No.: US 6,637,921 B2
(45) Date of Patent: Oct. 28, 2003

(54) REPLACEABLE LED BULB WITH INTERCHANGEABLE LENS OPTIC

(75) Inventor: Charles M. Coushaine, Rindge, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/966,045

(22) Filed: Sep. 28, 2001

(65) Prior Publication Data

US 2003/0063474 A1 Apr. 3, 2003

(51) Int. Cl.[7] ..... F21V 5/02

(52) U.S. Cl. ..... 362/517; 362/518; 362/297; 362/346

(58) Field of Search ..... 362/517, 518, 362/297, 346, 327, 328, 800, 545, 329, 339, 235, 249, 252

(56) References Cited

U.S. PATENT DOCUMENTS

| | | | | | |
|---|---|---|---|---|---|
| 4,013,915 | A | * | 3/1977 | Dufft | 362/800 |
| 4,965,488 | A | * | 10/1990 | Hihi | 362/800 |
| 5,323,300 | A | * | 6/1994 | McCrary | 362/104 |
| 5,769,532 | A | * | 6/1998 | Sasaki | 362/237 |
| 6,296,376 | B1 | * | 10/2001 | Kondo et al. | 362/310 |
| 6,488,392 | B1 | * | 12/2002 | Lu | 362/308 |

* cited by examiner

*Primary Examiner*—Thomas M. Sember
(74) *Attorney, Agent, or Firm*—William E. Meyer

(57) ABSTRACT

LED lamp assembly particularly adapted for automotive applications that utilizes one or more standard replaceable LED bulbs with changeable optics to make multiple beam patterns. Preferably the optic is molded and easily replaced. An electric module is mounted directly under the LED to facilitate the electrical connection and provide good thermal contact. The LED light source(s) and interchangeable optic are positioned and sealed in the base of a main reflector or the vehicle hull by means well known to those skilled in the art.

6 Claims, 8 Drawing Sheets

REPLACEABLE LED BULB WITH INTERCHANGEABLE LENS OPTIC

BACKGROUND OF THE INVENTION

Vehicle lamp assemblies generally include a light source, one or more reflectors for directing the light beam, and a lamp housing. Producing a standard LED (light emitting diode) bulb for automotive use has always been a goal of the lighting industry. However, multiple LED light sources are usually needed to make a standard beam pattern, which makes the application of the LED rather specific.

In addition, direct viewing of an LED lamp can be uncomfortable for the viewer. The light needs to be well spread, yet still sufficiently be directed or focused at the subject area. Through the appropriate use of reflectors, this can be accomplished. In automotive applications, however, the general reluctancy of the automobile manufacturer to cut holes in the vehicle hull to support a lamp assembly is often a formidable obstacle to allowing flexibility in designing suitable LED lamp assemblies that meet these objectives.

It is therefore an object of the present invention to provide an LED assembly that is compact and particularly suitable for automotive applications.

It is a further object of the present invention to provide an LED assembly interchangable with a lens optic to form multiple beam patterns.

It is yet a further object of the present invention to provide an LED assembly that requires only one LED.

It is still another object of the present invention to provide an LED light source with an interchangeable lens optic for automotive applications where the light is well spread and the assembly remains sufficiently thin to be mounted without forming holes in the vehicle hull.

SUMMARY OF THE INVENTION

The problems of the prior art have been overcome by the present invention, which provides an LED lamp assembly particularly adapted for automotive applications that utilizes one or more standard replaceable LED bulbs with changeable optics to make multiple beam patterns. Preferably the optic is molded and easily replaced. An electric module is mounted directly under the LED to facilitate the electrical connection and provide good thermal contact. The LED light source(s) and interchangeable optic are positioned and sealed in the base of a main reflector or the vehicle hull by means well known to those skilled in the art. In one embodiment, a cylinder is positioned around the LED's in order to protect the light source.

DETAILED DESCRIPTION OF THE INVENTION

Figure 1:
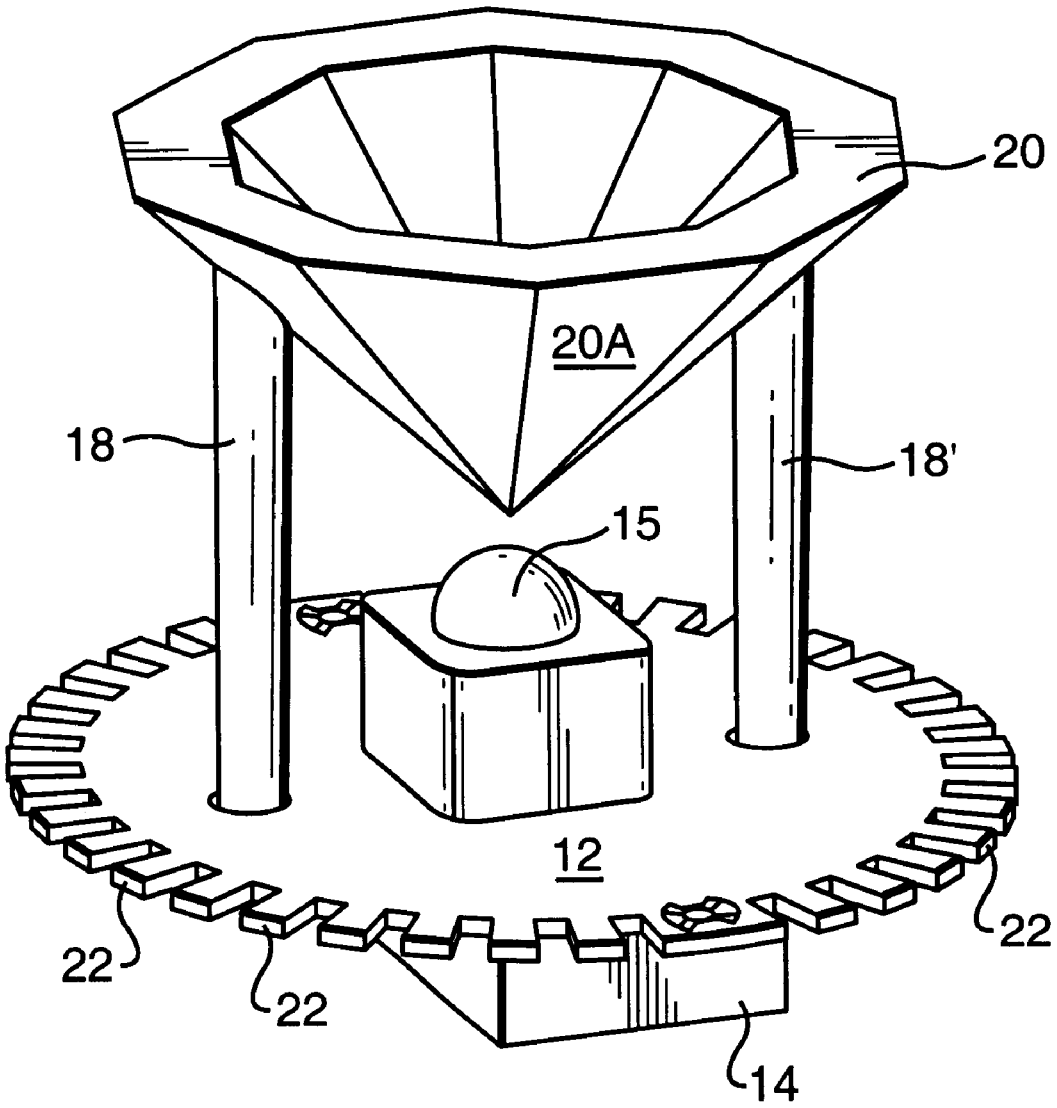
FIG. 1 is a perspective view of a replaceable LED Bulb interchangable with a lens optic in accordance with one embodiment of the present invention.

Turning first to FIG. 1, there is shown generally at 10 a lamp assembly in accordance with one embodiment of the present invention. The assembly includes a base plate 12, preferably made of metal so as to act as a heat sink. The base plate 12 can include a plurality of cooling fins 22 formed around its outer perimeter to assist in cooling the assembly. The shape of the cooling fins 22 is not particularly limited; for example, the fins 22 can taper towards their free end, be rounded at their corners, etc. The base plate 12 supports the LED light source or bulb 15 which is mounted to the plate by any suitable means. Positioned below or underneath the base plate 12 is an electric module 14 in electrical communication with the replaceable LED Bulb 15. Positioned above the LED bulb 15 is an optic or intermediate reflector 20. The optic 20 illustrated is a molded and metallized faceted (depending in part on desired beam spread) optic, having an outer reflective surface 20A facing the light source 15 for directing the light beam from the LED towards, for example, a main reflector in a desired beam pattern. The optic 20 is shown supported on base plate 12 by a pair of vertically depending spaced posts 18, 18' displaced sufficiently from the LED bulb 15 so as not to interfere with the light beam emanating therefrom. Preferably the posts 18, 18' insert into the plate 12 with a plurality of metal barbs to lock them in place. Alternatively, one or more light transmissive walls, screws, rivets, heat stake pins or other fastening means could be used to properly orient the intermediate reflector 20 relative to the bulb 15. The reflector 20 also could be centrally mounted such as with a central post 118 (FIG. 6) particularly suited for the embodiment with multiple LED light sources. Those skilled in the art will appreciate that the reflector 20 can be convex or concave.

Figure 2:
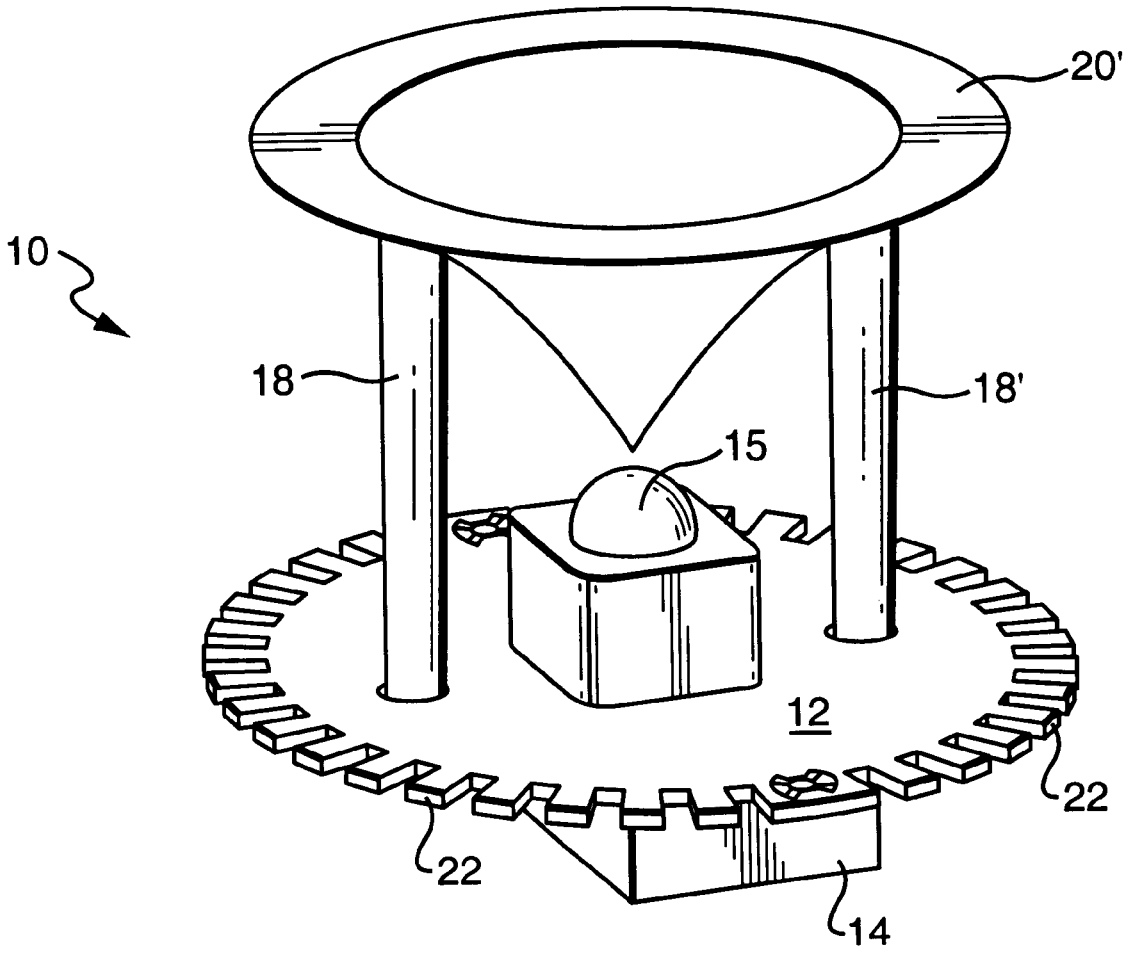
FIG. 2 is a perspective view of a replaceable LED Bulb interchangable with a lens optic in accordance with another embodiment of the present invention.

FIG. 2 illustrates another embodiment of the present invention, wherein the intermediate reflector 20' is conically shaped and has a smooth outer reflective surface facing the LED light source 15.

Figure 3:
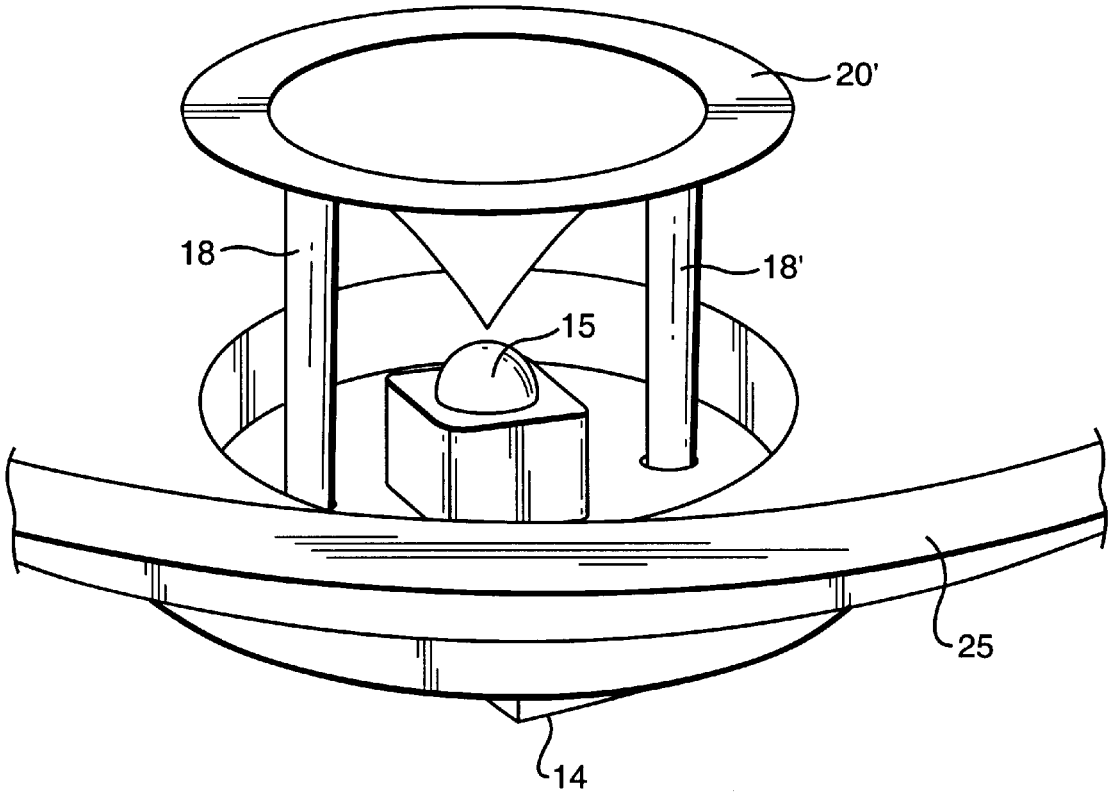
FIG. 3 is a perspective view the LED assembly of FIG. 2 positioned in a reflector.
Figure 4:
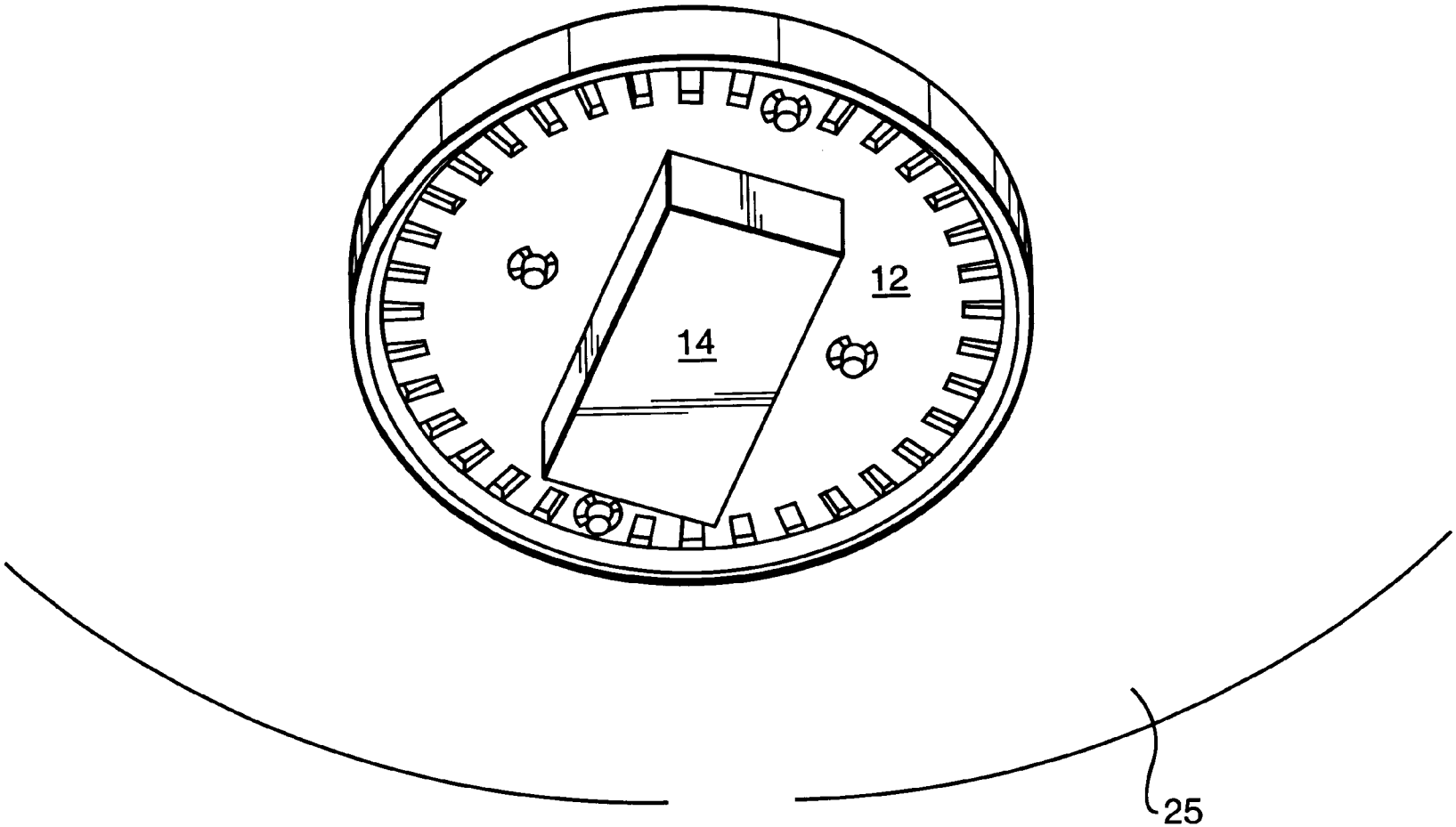
FIG. 4 is a rear view of the assembly of FIG. 3.

FIG. 3 shows the assembly of FIG. 2 positioned in a main reflector 25. The main reflector 25 is configured in the form of a hollow shell or cone and defines an enclosed volume. The interior surface of the reflector 25 is reflective and generally faces in a forward axial direction towards the intermediate optic 20'. The LED and intermediate optic assembly is positioned in the volume defined by the main reflector 25 as shown, such that the central axis of the assembly bisects the light source 15. Preferably the main reflector 25 is generally symmetric about this central axis. The mounting of the LED and intermediate reflector assembly to the main reflector 25 is also shown from the backside in FIG. 4. The LED and intermediate reflector assembly are joined as a replaceable unit in the main reflector 25. A light transmissive cover lens (not shown) closing the defined opening in the main reflector 25 can be used.

Figure 5B:
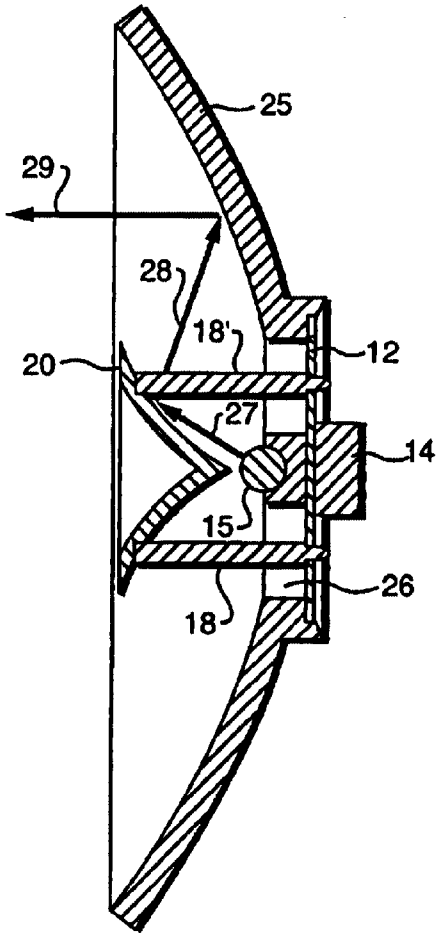
FIG. 5B is a cross-sectional view taken along lines 5—5 of FIG. 5A.
Figure 5A:
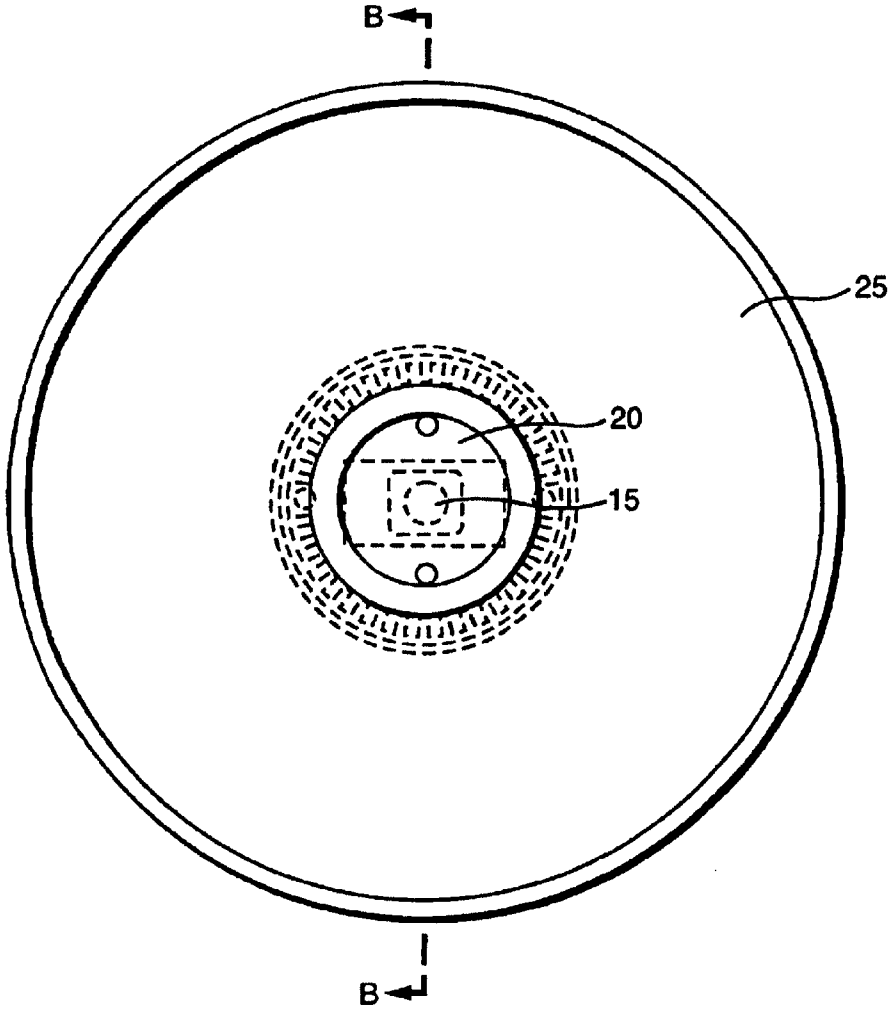
FIG. 5A is a top view of the assembly of FIG. 4.

Turning now to FIGS. 5A and 5B, the lamp assembly in its assembled condition is shown. The reflector 25 has a well 26 formed in its base which houses the LED bulb 15 and base plate 12. The spaced posts 18, 18' can be seen penetrating the base plate 12 to secure them therein. Arrows 27, 28 and 29 depict the light beam emanating from the LED bulb 15 and impinging on the reflective outer surface of the intermediate reflector 20, being reflected from the outer reflective surface of intermediate reflector 20 and impinging on the reflective surface of main reflector 25, and being reflected from the reflective surface of the main reflector 25.

Figure 6:
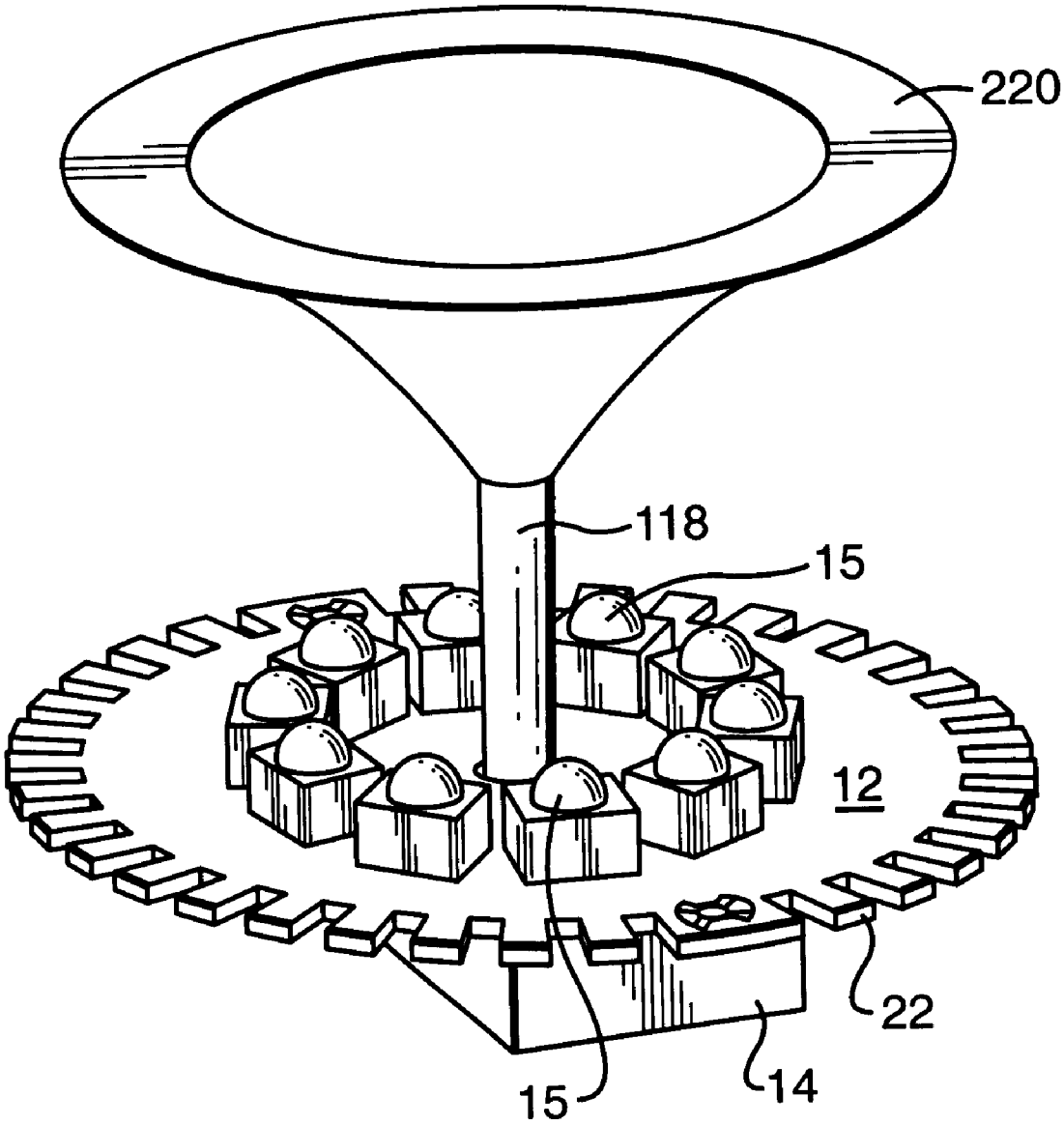
FIG. 6 is a perspective view of a plurality of replaceable LED Bulbs interchangable with a optic in accordance with yet another embodiment of the present invention.

FIG. 6 illustrates an alternative embodiment wherein a plurality of LED light sources 15 are employed. Preferably the LED light sources 15 are positioned in a circular array, uniformly spaced from one another. A plurality of concentric circular arrays also can be employed, each array having the same or a different number of LEDs from another array. In the embodiment shown, there is a single circular array of 10 spaced LED light sources 15, although those skilled in the art will appreciate that more or less could be used. The optic 220 has a single centrally located vertically depending post 118 mounted to the base plate 12 which supports the optic 220. In view of the location of the LED light sources 15 in this embodiment, the centrally located post 118 does not interfere with the light being emitted. Of the plurality of LED light sources 15, LED light sources of different colors can be used, and the light sources of different color can be independently operated electrically.

Figure 7:
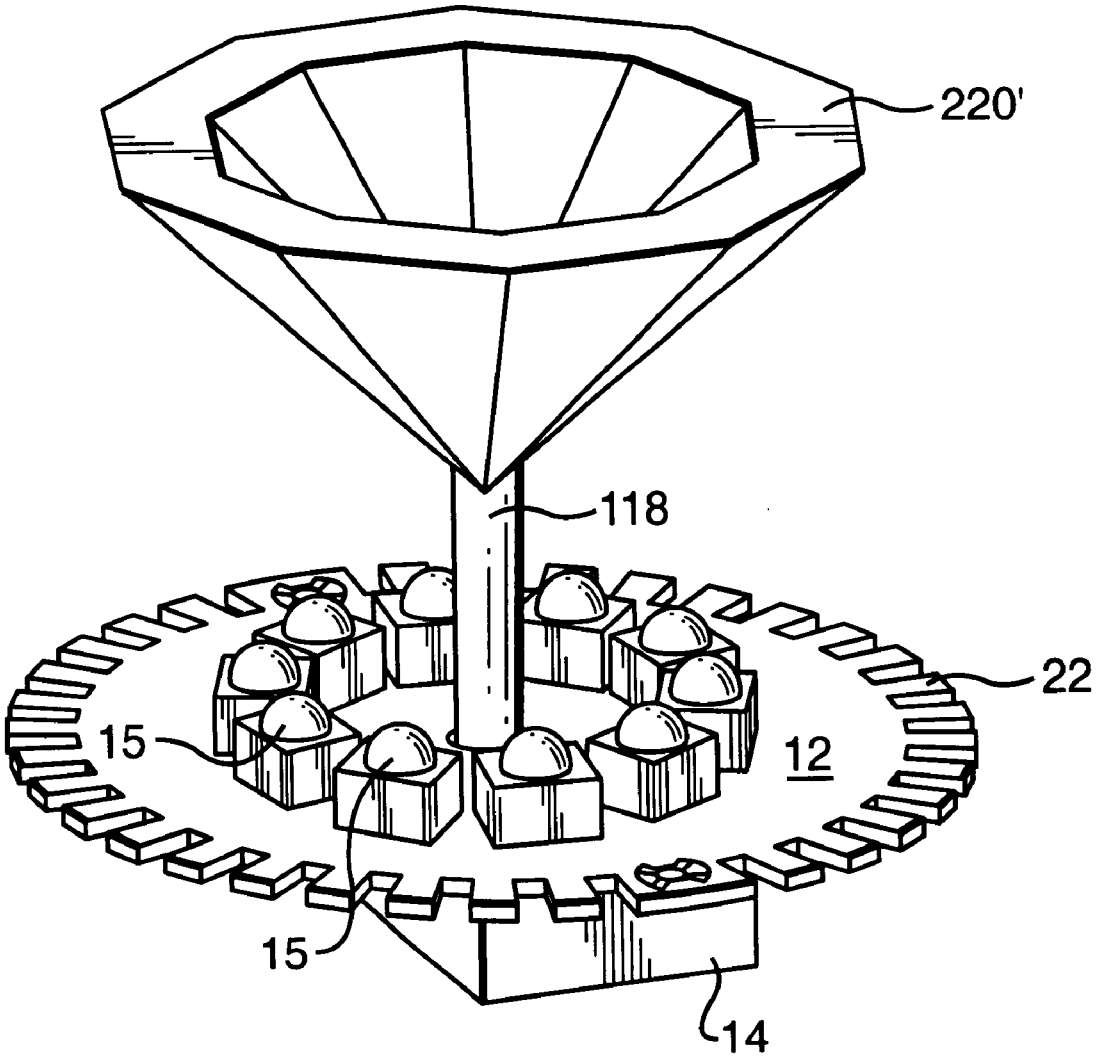
FIG. 7 is a perspective view of a plurality of replaceable LED Bulbs with a different interchangeable optic in accordance with still another embodiment of the present invention.

The embodiment of FIG. 7 is similar to that of FIG. 6, except that the reflector 220' is a faceted reflector as shown.

Figure 8B:
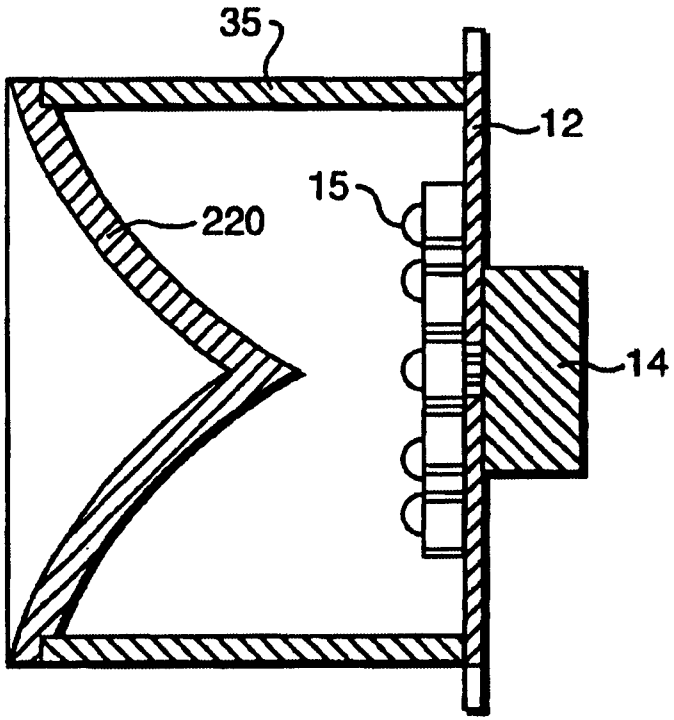
FIG. 8B is a view taken along line B—B of FIG. 8A.
Figure 8A:
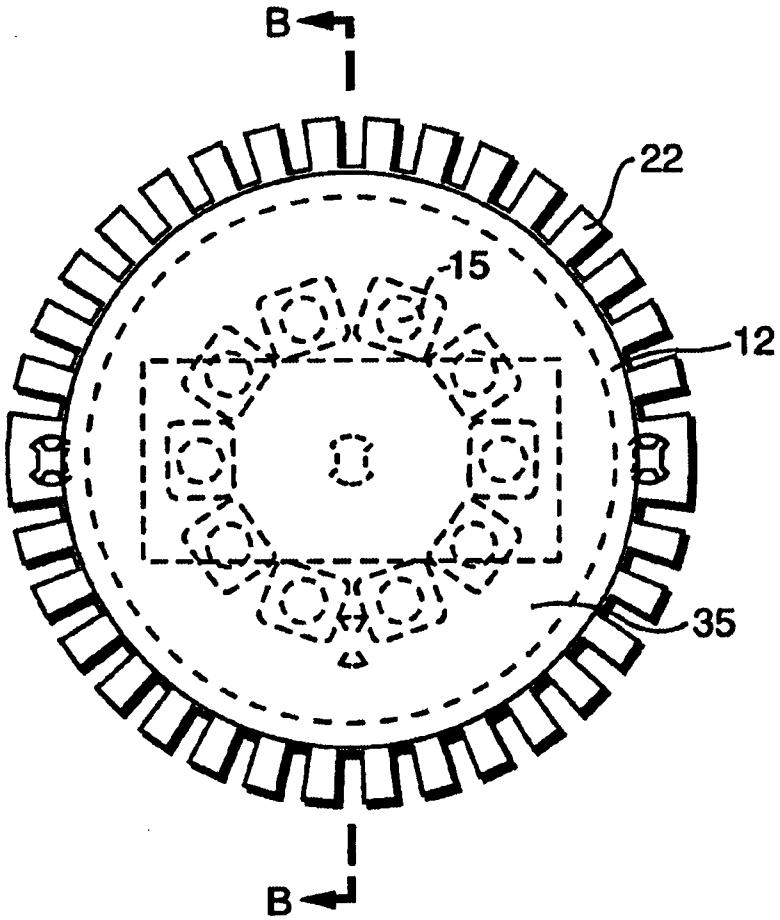
FIG. 8A is a top view, with portions in phantom, of another embodiment of the assembly in accordance with the present invention.

FIGS. 8A and 8B show another embodiment of the present invention, which includes a cylinder 35 supported on the base plate 12 about the LED's 15. The interchangeable lens optic 220 is then placed on top of the cylinder 35 as shown, and thereby supports the optic 220. Preferably the cylinder 35 is made of clear glass or acrylic. It acts to protect the light source and the optic. Those skilled in the art will appreciate that other configurations could be used to support the optic and protect it and the light source, as long as it does not interfere with the light emanating from the light source.

The resulting assembly is simple and inexpensive to assemble without sacrificing performance. A short, flat optical package is created utilizing one or more standard LED bulbs. The assembly is sufficiently "thin" to allow a dented type mounting to be used.

What is claimed is:

1. A lamp assembly, comprising:

a replaceable base, being replaceable with respect to a surrounding enclosure; one or more LED light sources supported on said replaceable base, said one or more LED light sources each adapted to emit light in a predetermined, substantially forward direction; and an optic in the form of a preliminary reflector supported from said replaceable base and forward of said LED light sources and oriented with respect to said one or more LED light sources to intercept said light emanating forward from said one or more LED light sources and direct the same in a predetermined pattern to a main reflector surrounding said replaceable base, said one or more LED light sources and said optic, such that light the LED light sources is reflected by the preliminary reflector to the main reflector to be reflected by the main reflector to a field to be illuminated.

2. The lamp assembly of claim 1, wherein said optic is faceted.

3. The lamp assembly of claim 1, wherein said predetermined pattern defines an axis, and wherein said optic is supported on said base by two or more depending posts offset from said axis.

4. The lamp assembly of claim 1, wherein there are a plurality of LED light sources arranged in a circular array.

5. The lamp assembly of claim 4, wherein said optic is supported over said base by a depending central post.

6. The lamp assembly of claim 1, wherein said optic is supported over said base by a cylinder surrounding said one or more LED light sources.

* * * * *